United States Patent [19]

Martino

[11] Patent Number: 4,674,394

[45] Date of Patent: Jun. 23, 1987

[54] PORTABLE BULLET-PROOF SHIELD

[75] Inventor: Philip C. Martino, Pittsfield, Mass.

[73] Assignee: Pro-Tech Armored Products of New York, Inc., Pittsfield, Mass.

[21] Appl. No.: 788,004

[22] Filed: Oct. 16, 1985

[51] Int. Cl.[4] ..... F41H 5/08

[52] U.S. Cl. ..... 89/36.05; 2/2.5; 109/49.5; 428/911

[58] Field of Search ..... 2/2.5; 89/36.05; 109/49.5, 58.5; 224/257; 428/911

[56] References Cited

U.S. PATENT DOCUMENTS

| | | | |
|---|---|---|---|
| 1,348,204 | 8/1920 | Brewster | 2/2.5 |
| 1,350,062 | 8/1920 | Brewster | 2/2.5 |
| 3,370,302 | 2/1968 | Karlyn | 2/2.5 |
| 4,413,357 | 11/1983 | Sacks | 2/2.5 |

FOREIGN PATENT DOCUMENTS

| | | | |
|---|---|---|---|
| 2450439 | 9/1980 | France | 2/2.5 |
| 2122732 | 1/1984 | United Kingdom | 89/36.05 |
| 2124887 | 2/1984 | United Kingdom | 2/2.5 |
| 2144973 | 3/1985 | United Kingdom | 2/2.5 |

*Primary Examiner*—Stephen C. Bentley
*Attorney, Agent, or Firm*—Brady, O'Boyle & Gates

[57] ABSTRACT

A portable bullet-proof shield for use by law enforcement agents, is horizontally curved and of sufficient height and width to protect substantially the body of the user when the shield is being carried or is resting in a free-standing mode. The shield includes a viewing lens assembly near its top, an adjustable shoulder suspension strap, a horizontal hand grip bar, and elastic horizontal stand-off straps on its interior side to protect the body against "blunt trauma". The shield has a frontal skin formed of aluminum or high-impact plastics behind which is disposed a penetration-resistant wall consisting of multiple layers of woven synthetic fabric which may be laminated or non-laminated. A single layer of waterproof synthetic fabric or rear skin formed of high-impact plastics defines the interior face of the shield. The shield possesses a frame consisting of top, intermediate and bottom horizontal bows which are riveted to the shield primarily at opposite side rearwardly projecting portions of the shield. When the rear skin is formed of high-impact plastics, these may be integrally formed into the skin. The top and bottom edges of the shield may be capped with tough plastics material. The viewing lens assembly includes multiple thicknesses of clear penetration-resisting plastics material held in assembled relationship by front and rear lens caps secured by interfitting bolts and tubular nuts which penetrate the body of the shield, or integrally formed when the frontal and rear skins are formed of plastics.

13 Claims, 8 Drawing Figures

PORTABLE BULLET-PROOF SHIELD

BACKGROUND OF THE INVENTION

The objective of the present invention is to provide a bullet-proof portable shield for use by law enforcement agents and the like which is lightweight and capable of resisting penetration by multiple impacts by most hand gun bullets without causing ricochets or flying fragments. When the shield is constructed so that it possesses a frontal layer of ceramic armor, it can resist high powered ammunition rounds from rifles.

A further object of the invention is to provide a bullet-proof shield which is shaped and sized to protect substantially the entire body of a user when the user is in a crouching position.

Another object of the invention is to provide a shield which can be adjustably suspended from a shoulder of a user and which possesses a hand grip bar acting in concert with a shoulder suspension strap, whereby the user can quickly shift the shield from side-to-side on the body so that the shield will frontally face the path of fire.

Another object of the invention is to provide a bullet-proof shield which enables visual surveillance over a wide area while the shield is protecting the user from gun fire coming from any direction.

An important object of the invention is to provide a bullet-proof shield of the mentioned character having means to protect the body of a user from "blunt trauma" caused by the impacting of bullets on the shield which do not penetrate the shield.

Still another object of the invention is to provide a shield of the character mentioned which is constructed from state of the art materials, rendering the manufacturing of the shield economical and practical.

Another object of the invention is to provide a bullet-proof shield having a minimum number of rivets or other fasteners in the frontal area of the shield where they could become lethal projectiles if struck directly by a bullet.

Other features and advantages of the invention will become apparent to those skilled in the art during the course of the following detailed description.

DETAILED DESCRIPTION

Figure 1:
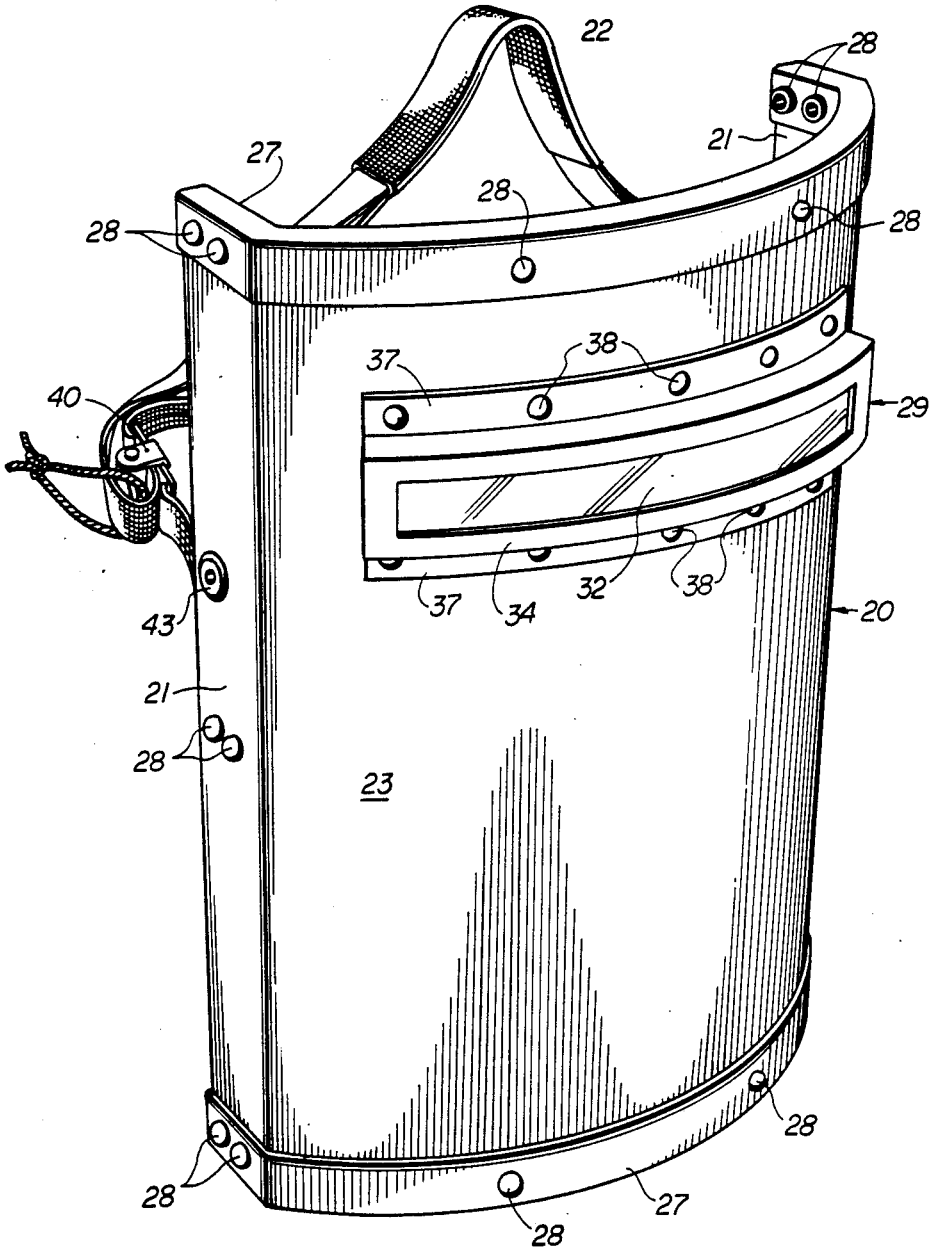
FIG. 1 is a front perspective view of a portable bullet-proof shield according to the present invention.
Figure 2:
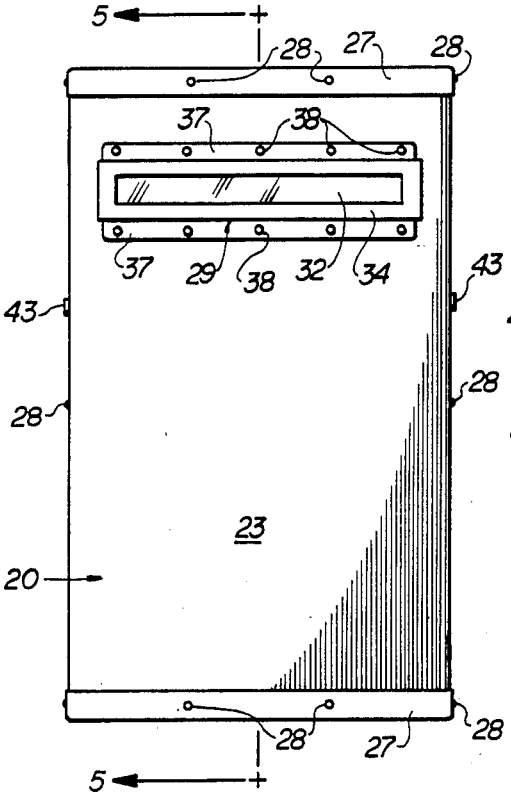
FIG. 2 is a front elevation of the shield on a somewhat reduced scale.

Referring to the drawings in detail wherein like numerals designate like parts, a portable bullet-proof shield 20 according to the present invention is typically 48 inches in height by 24 inches wide, although these dimensions can be varied in some cases. The front wall of the shield is circularly curved horizontally, preferably on an 18 inch radius. The shield has two parallel flat rearwardly extending side walls 21 which are approximately 3 inches wide in the front-to-back direction.

With the described shape and dimensions, the bullet-proof shield 20 can effectively protect substantially the entire body of a crouching user of the shield when the shield is freestanding as shown in FIG. 1 or while it is suspended on the body by an adjustable shoulder suspension strap 22, to be further described. The bullet-proof shield is constructed in the following manner. A frontal or outer skin 23 formed of sheet aluminum, or in some cases high-impact plastics, such as for example a biaxially-oriented polypropylene, has located immediately behind it a comparatively thick penetration-resistant wall 24, preferably formed of 10 to 30 layers of 1500 denier woven aramid material, such as KEVLAR "29" manufactured by E. I. duPont de Nemours, or equivalent material. Seventeen thin KEVLAR "29" layers have proven effective when bonded and laminated together with a low concentration of bonding agent, such as a resin, or the several woven fabric layers may remain unbonded and unlaminated, in which case a few additional layers are required. The rear face of the penetration-resistant wall 24 is covered by a sheet 25 of waterproof nylon or an equivalent material. Typically, the wall of the shield 20 composed of the skin 23, multiple KEVLAR "29" layers and waterproof sheet 25 is approximately one-half inch thick, although this dimension could be varied slightly. The wall of the shield is relatively rigid, although somewhat bendable, and by using conventional metal break apparatus the two narrow side walls 21 of the shield can be readily formed.

So that the shield 20 will hold its shape and the multiple KEVLAR layers forming the penetration-resistant wall 24 will be held in, and also will not sag, and separate, when not laminated, an internal shield frame structure is provided. This frame structure comprises the bentaround rear vertical edges 47, 48 of the skin 23, to be discussed later herein, and the top, intermediate and bottom bows 26 or spars, preferably formed of aluminum, and being thick enough to provide substantial rigidity. Aluminum bows formed of 0.156 inch thick stock are suitable.

The top and bottom edges of the shield 20 are enclosed and finished by U-cross section caps 27 formend of tough plastics material. These caps enclose the top and bottom aluminum bows 26 as well as the adjacent portions of the skin 23, wall 24 and waterproof sheet 25.

Figure 5:
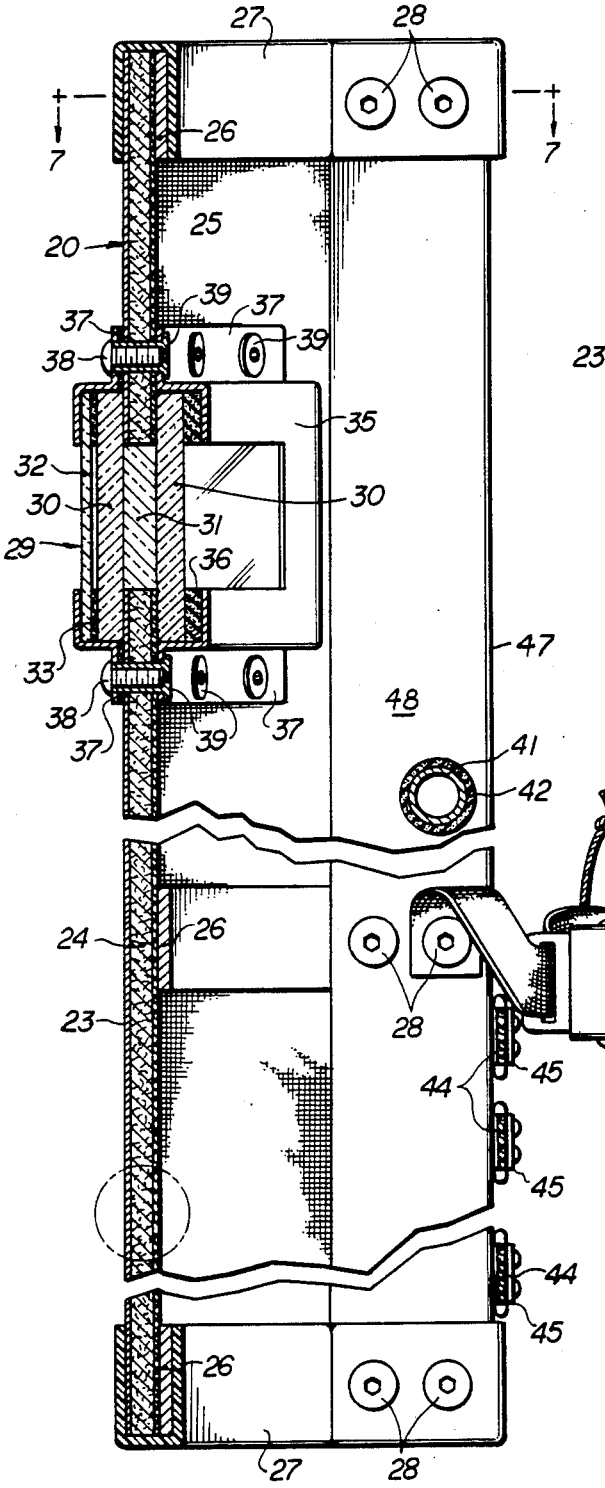
FIG. 5 is an enlarged fragmentary vertical section taken on line 5—5 of FIG. 2.
Figure 6:
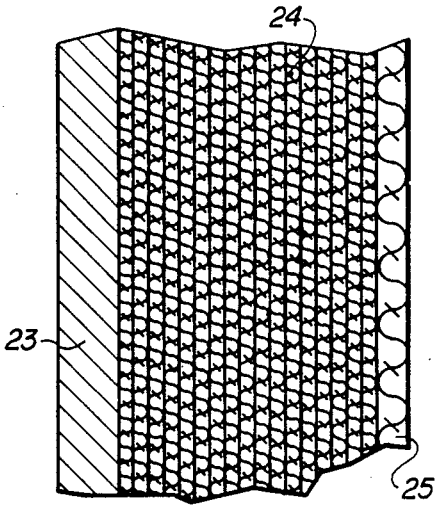
FIG. 6 is an enlarged fragmentary vertical section of the area encircled by a phantom line in FIG. 5.

The three stiffening bows 26 are secured by rivets 28 which, in the case of the top and bottom bows, penetrate the finishing caps 27 as well as the bows 26 and the wall of the shield. In the case of the intermediate bow 26, the rivets 28 penetrate the bow 26 and the wall of the shield including its outer skin 23 and the waterproof sheet 25. As shown in FIGS. 1 and 5, most of the rivets 28 are located on the narrow side walls 21 of the shield and are thus out of the direct line of fire. Only two rivets 28 for the top and bottom bows 26 are located on the front of the shield, close to its top and bottom edges. Thus, there is an extremely small likelihood of a bullet directly striking one of the rivets during the use of the shield by a police officer or the like.

Near and below its top edge, the shield 20 is equipped with a viewing lens assembly 29 of unique construction. Forward and rear, preferably one-half inch thick, polycarbonate lens plates 30 are placed immediately forwardly of the skin 23 and rearwardly of the sheet 25. An intermediate one-half inch thick lens plate 31, FIG. 5, also formed of polycarbonate, is placed between the lens plates 30 within an opening in the curved frontal wall of the shield 20. As shown in the drawings, the lens plates extend across a major portion of the horizontal width of the shield 20 on its curved frontal wall, and the lens plates themselves are curved on the same radius of curvature as the shield frontal wall. A comparatively thin one-quarter inch thick mar-resistant polycarbonate transparent plate 32 is placed forwardly of the lens plate 30 and separated slightly therefrom by a suitable gasket 33. Forward and rear extruded aluminum lens caps 34 and 35 hold and retain the lens plates on the shield frontal wall, as shown. A resilient compressible foam tape or gasket 36 within the rear lens cap 35 presses on the rear lens plate 30 and maintains the four polycarbonate lens plates in stacked relationship without play or rattling.

Marginal flanges 37 of the lens caps 34 and 35 are fixedly secured to the frontal curved wall of the shield 20 by interfitting bolts 38 and tubular nuts 39 which penetrate the wall of the shield as shown in FIG. 5. The viewing window afforded by the lens assembly 29 is vertically narrow and horizontally wide so as to provide a wide field of vision across the shield horizontally, thus enabling visual surveillance of a subject or area without loss of protection for the user of the shield.

The previously-mentioned shoulder suspension strap 22 has its opposite ends anchored by one of the rivets 28 for the intermediate bow 26 on each side of the shield. The strap 22 is equipped with conventional quick-release buckle means 40.

Between the viewing lens assembly 29 and shoulder suspension strap 22, at the rear of the shield, a horizontal circular cross section hand grip bar 41 is provided, covered by a Neoprene gripping sleeve 42. The opposite ends of the hand grip bar 41 are anchored to the parallel side walls 21, as indicated at 43 in the drawings.

Figure 3:
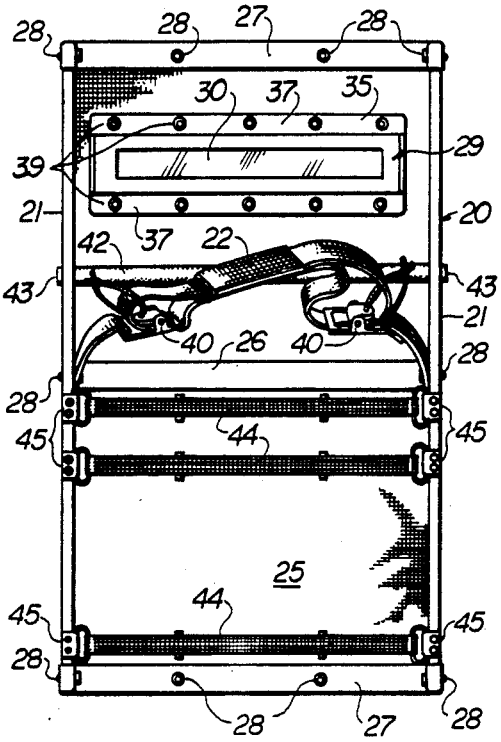
FIG. 3 is a rear elevation of the shield.

A very important feature of the invention is the provision on the rear of the shield of preferably three parallel horizontal adjustable elastic stand-off straps 44. A pair of these straps is located near and below the intermediate bow 26 and one stand-off strap 44 is located close to the bottom finishing cap 27, FIG. 3. The stand-off straps 44 are equipped with end connectors 45 which are secured to the rear vertical edges of the shield side walls 21. The elastic straps 44, being taut, cause the shield to stand off or be spaced from the body of the user to protect the user from "blunt trauma" caused by impact of bullets on the shield. With the user in a standing position and the shield suspended from a shoulder by the strap 22 so that the lens assembly 29 is at eye level, the straps 44 will engage the upper thighs and the legs near or below the knees.

The strap 22 can suspend the shield from either shoulder and the hand grip bar 41 can be grasped with either hand, depending upon convenience. The shield can be held at all times so that the curved frontal wall faces the likely line of fire, thus offering maximum protection to the user.

Figure 8:
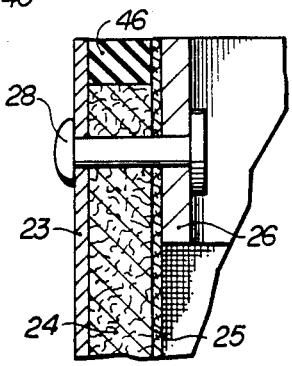
FIG. 8 is an enlarged fragmentary vertical section through the top edge portion of a shield in accordance with a modification of the invention.

As shown in FIG. 8, in lieu of the finishing caps 27, the top and bottom edges of the shield between the frontal skin 23 and waterproof sheet 25 may be filled with a waterproof sealant 46 which seals and protects the KEVLAR "29" layers embodied in the penetration-resistant wall 24. The edge caps 27 of the prior embodiment also protect the KEVLAR "29" layers from moisture as does the waterproof nylon sheet 25.

When the KEVLAR "29" layers are laminated or not laminated, the rivets 28, the fasteners 38–39, and the bows 26, support the same in position against the skin 23, and prevent the material when not laminated from sagging or moving in any direction during the handling of the shield.

The approximate weight of the shield as described herein is thirty pounds.

Figure 7:
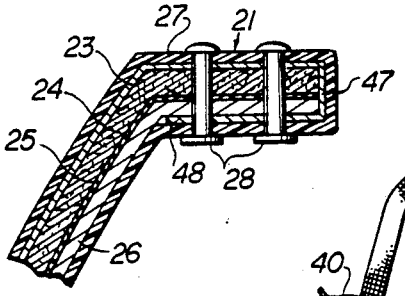
FIG. 7 is an enlarged fragmentary horizontal section taken on line 7—7 of FIG. 5.
Figure 4:
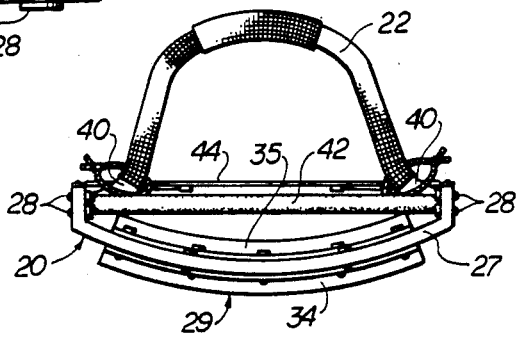
FIG. 4 is a plan view thereof.

With reference to drawing FIG. 7, it can be seen that the aluminum skin 23 extends completely around the outer sides of the side walls 21, across their rear edges as shown at 47, and then forwardly over their interior faces as shown at 48. This U-shaped construction stiffens the structure at its side walls without appreciably adding to the weight of the shield, forms a rigid support for the bows 26 to complete the frame structure of the shield, and encloses and waterproofs the rear vertical edges of the penetration-resistant wall 24.

It should be noted that the waterproof nylon backing sheet 25 is adhesively bonded to the penetration-resistant wall 24.

Where the frontal skin of the shield is formed of synthetic material, such as high-impact plastics, the front lens cap 34 can be formed of the same material and can be formed integrally with the frontal skin as a unit, rather than as a separate component, as described previously. Also, with this construction, in lieu of the waterproof nylon sheet 25 and the separate bows 26, a rear skin may be provided, formed on a mating curvature with the front skin 23 and of the same high-impact plastics material as the front skin, with the rear lens cap formed integrally as a unit with the rear skin. Structural ribs, in place of the separate bows 26, may be integrally formed into the rear skin during a molding or forming process for the rear skin such that the rear skin, rear lens cap and plural curved ribs are formed as a single unit. This construction eliminates the need of the separate waterproof nylon backing sheet and the separate bows. The integrally formed rear skin, has rearwardly extending sidewalls parallel with the side walls 21 of the frontal skin 23, which are riveted to the side walls 21 of the frontal skin 23. With such a construction it is also possible to reduce the width of the KEVLAR layers in the shield so that they lie just in between the curved portions of the frontal skin 23 and the rear skin, and not between the mating side walls 21 of the two skins. The side walls of the two skins may be positioned in overlying relationship to each other and directly riveted to each other so that they, together with the embossed ribs in the rear skin form the rigid frame for the shield.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A portable bullet-proof shield comprising a horizontically curved and vertically elongated body portion having rearwardly extending relatively narrow parallel side wall extensions, a viewing lens assembly on said body portion near and below its top and being horizontically elongated, a shoulder suspension strap and hand grip means on the body portion, and the body portion comprising a frontal exterior hard skin, a comparatively thick penetration-resistant wall consisting of a multiplicity of thin horizontally stacked layers of woven synthetic textile material and a waterproof backing sheet for said layers of textile material adhered thereto, and a frame for said shield including top, intermediate and bottom bows engaging the rear interior face of said body portion and being secured thereto by fasteners which penetrate the bows and said body portion.

2. A portable bullet-proof shield as defined in claim 1, and said fasteners comprising rivets placed in said narrow parallel side walls.

3. A portable bullet-proof shield as defined in claim 1, and said skin comprising an aluminum sheet, said layers comprising approximately seventeen layers of woven aramid material, and said backing sheet comprising waterproof nylon.

4. A portable bullet-proof shield as defined in claim 1, and said viewing lens assembly comprising forward and rear transparent lens plates at the front and rear faces of said body portion, an intermediate lens plate between the front and rear lens plates and disposed within an opening of the body portion, and front and rear lens caps fixed to said body portion and holding said lens plates in assembled relationship on the body portion.

5. A portable bullet-proof shield as defined in claim 4, and said lens caps having flanges lying on the front and rear faces of the body portion above and below the lens plates, and fasteners penetrating said flanges and said body portion and securing the flanges to the body portion.

6. A portable bullet-proof shield as defined in claim 5, and a resilient compressible element held between the rear lens plate and rear lens cap and exerting pressure on the rear lens plate to maintain the lens plates in fixed stacked relationship.

7. A portable bullet-proof shield as defined in claim 6, and a mar-resistant transparent forwardmost transparent plate fixed between the forward lens plate and forward lens cap.

8. A portable bullet-proof shield as defined in claim 7, and said lens plates and transparent plate being formed of polycarbonate.

9. A portable bullet-proof shield as defined in claim 1, and at least an elastic substantially taut stand-off strap across the rear of the shield below the level of said viewing lens assembly.

10. A portable bullet-proof shield of a shape and size to substantially protect the body of a user of the shield when the shield is positioned to face a line of fire, means on the shield adapting it to be carried by a user, stand-off means on the shield adapted to engage the body to protect the body against blunt trauma by impacting of bullets on the shield, a viewing lens assembly on the shield near and below its top, and the shield having a body portion consisting of an outer skin of sheet material, a comparatively thick penetration-resistant layer formed of a multiplicity of thin synthetic fabric sheets and an inner skin of sheet material, said body portion being frontally curved horizontally and having rearwardy extending comparatively narrow side walls, and a rigidifying frame for the shield including top, intermediate and bottom bows engaging the rear interior face of the body portion and extending for substantially the full width thereof, said stand-off means and said rigidifying frame being attached to said side walls.

11. A portable bullet-proof shield as defined in claim 10, and top and bottom edge finishing and waterproofing means on the body portion.

12. A portable bullet-proof shield as defined in claim 11, and the finishing and waterproofing means comprising U-cross section caps placed over the top and bottom edges of the body portion and being fixed thereto.

13. A portable bullet-proof shield as defined in claim 11, and said finishing and waterproofing means comprising a sealant placed in grooves of the top and bottom edges of the body portion between said skin and inner skin of sheet material.

* * * * *